US007624515B2

(12) United States Patent
Kita et al.

(10) Patent No.: US 7,624,515 B2
(45) **Date of Patent: *Dec. 1, 2009**

(54) SOLE STRUCTURE FOR A SHOE

(75) Inventors: Kenjiro Kita, Ikoma-gun (JP); Takao Oda, Takarazuka (JP); Akihiro Miyauchi, Kawanishi (JP)

(73) Assignee: Mizuno Corporation, Osaka-shi (JP)

( * ) Notice: Subject to any disclaimer, the term of this patent is extended or adjusted under 35 U.S.C. 154(b) by 471 days.

This patent is subject to a terminal disclaimer.

(21) Appl. No.: 11/444,153

(22) Filed: May 30, 2006

(65) Prior Publication Data

US 2006/0265902 A1 Nov. 30, 2006

Related U.S. Application Data

(63) Continuation-in-part of application No. 11/317,322, filed on Dec. 22, 2005, now Pat. No. 7,484,317.

(30) Foreign Application Priority Data

May 30, 2005 (JP) ..... 2005-156635

(51) Int. Cl.
*A43B 13/12* (2006.01)

(52) U.S. Cl. ..... 36/30 R; 36/27; 36/67 R; 36/28; 36/25 R

(58) Field of Classification Search ..... 36/30 R, 36/27, 67 R, 28, 25 R, 31, 35 R, 128, 126
See application file for complete search history.

(56) References Cited

U.S. PATENT DOCUMENTS 75,900 A 3/1868 Hale et al.
224,937 A 2/1880 Mintzer
291,490 A 1/1884 Buch
324,065 A 8/1885 Andrews
357,062 A 2/1887 Buch (Continued)

FOREIGN PATENT DOCUMENTS

JP 2003-009906 1/2003

(Continued)

OTHER PUBLICATIONS

Wright, Karen, "Shoeing the Athlete", Discover, Feb. 2000, pp. 35-36.

(Continued)

*Primary Examiner*—Ted Kavanaugh
(74) *Attorney, Agent, or Firm*—W. F. Fasse; W. G. Fasse

(57) ABSTRACT

A sole structure is provided that can improve cushioning and bending properties of the sole heel portion. The sole assembly 1 is formed of an upper plate 2 disposed on the upper side of the heel portion H, a wavy lower plate 3 provided below the upper plate 2 in the heel portion H and having at least two convex portions 30, 31 that protrude downwardly and that are adapted to form voids C relative to the upper plate 2, and a plurality of cleats that are provided on the lower surfaces of the convex portions of the lower plate and/or a cleat that is provided between adjacent convex portions of the lower plate.

24 Claims, 16 Drawing Sheets

U.S. PATENT DOCUMENTS

| | | | | |
|---|---|---|---|---|
| 413,693 | A | | 10/1889 | Walker |
| 427,136 | A | | 5/1890 | Walker |
| 766,101 | A | | 7/1904 | Croner |
| 871,864 | A | | 11/1907 | Feazell et al. |
| 898,084 | A | | 9/1908 | Backermann |
| 1,088,328 | A | | 2/1914 | Cucinotta |
| 1,352,865 | A | | 9/1920 | Augestad |
| 1,469,920 | A | | 10/1923 | Dutchak |
| 1,471,966 | A | | 10/1923 | Light |
| 1,587,749 | A | | 6/1926 | Bierly |
| 1,625,048 | A | | 4/1927 | Nock |
| 1,638,350 | A | | 8/1927 | Long |
| 1,726,028 | A | | 8/1929 | Keller |
| 1,929,126 | A | | 10/1933 | Tuki et al. |
| 1,942,312 | A | | 1/1934 | Tutoky |
| 2,172,000 | A | | 9/1939 | Wenker |
| 2,399,543 | A | | 4/1946 | Dack |
| 2,413,545 | A | | 12/1946 | Cordi |
| 2,447,603 | A | | 8/1948 | Snyder |
| 2,814,132 | A | | 11/1957 | Montoscuro |
| 2,953,861 | A | | 9/1960 | Horten |
| 3,886,674 | A | | 6/1975 | Pavia |
| 4,241,523 | A | | 12/1980 | Daswick |
| 4,309,832 | A | | 1/1982 | Hunt |
| 4,342,158 | A | | 8/1982 | McMahon et al. |
| 4,457,084 | A | | 7/1984 | Horibata et al. |
| 4,492,046 | A | | 1/1985 | Kosova |
| 4,492,374 | A | | 1/1985 | Lekhtman et al. |
| 4,534,124 | A | | 8/1985 | Schnell |
| 4,566,206 | A | | 1/1986 | Weber |
| 4,592,153 | A | | 6/1986 | Jacinto |
| 4,638,575 | A | | 1/1987 | Illustrato |
| 4,843,737 | A | | 7/1989 | Vorderer |
| 4,881,329 | A | | 11/1989 | Crowley |
| 4,910,884 | A | | 3/1990 | Lindh et al. |
| 5,005,300 | A | | 4/1991 | Diaz et al. |
| 5,060,401 | A | | 10/1991 | Whatley |
| 5,138,776 | A | | 8/1992 | Levin |
| 5,279,051 | A | | 1/1994 | Whatley |
| 5,282,325 | A | | 2/1994 | Beyl |
| 5,343,636 | A | | 9/1994 | Sabol |
| 5,353,523 | A | | 10/1994 | Kilgore et al. |
| 5,367,790 | A | | 11/1994 | Gamow et al. |
| 5,381,608 | A | | 1/1995 | Claveria |
| 5,396,718 | A | | 3/1995 | Schuler et al. |
| 5,435,079 | A | | 7/1995 | Gallegos |
| 5,461,800 | A | | 10/1995 | Luthi et al. |
| 5,477,626 | A | | 12/1995 | Kwon |
| 5,513,448 | A | | 5/1996 | Lyons |
| 5,577,334 | A | | 11/1996 | Park |
| 5,706,589 | A | | 1/1998 | Marc |
| 5,729,916 | A | | 3/1998 | Vorobiev et al. |
| 5,822,886 | A | | 10/1998 | Luthi et al. |
| 5,875,567 | A | | 3/1999 | Bayley |
| 5,896,679 | A | | 4/1999 | Baldwin |
| 5,916,071 | A | | 6/1999 | Lee |
| 5,940,994 | A | | 8/1999 | Allen |
| 6,006,449 | A | | 12/1999 | Orlowski et al. |
| 6,029,374 | A | | 2/2000 | Herr et al. |
| 6,065,230 | A | | 5/2000 | James |
| 6,079,126 | A | | 6/2000 | Olszewski |
| 6,145,221 | A | * | 11/2000 | Hockerson ..... 36/126 |
| 6,282,814 | B1 | | 9/2001 | Krafsur et al. |
| 6,393,731 | B1 | | 5/2002 | Moua et al. |
| 6,449,878 | B1 | | 9/2002 | Lyden |
| 6,457,261 | B1 | | 10/2002 | Crary |
| 6,557,270 | B2 | * | 5/2003 | Nakano et al. ..... 36/25 R |
| 6,601,042 | B1 | | 7/2003 | Lyden |
| 6,625,905 | B2 | * | 9/2003 | Kita ..... 36/30 R |
| 6,769,202 | B1 | | 8/2004 | Luthi et al. |
| 6,796,056 | B2 | | 9/2004 | Swigart |
| 6,826,852 | B2 | | 12/2004 | Fusco |
| 6,860,034 | B2 | * | 3/2005 | Schmid ..... 36/27 |
| 6,935,055 | B2 | * | 8/2005 | Oorei ..... 36/129 |
| 7,334,351 | B2 | | 2/2008 | Hann |
| 7,484,317 | B2 | * | 2/2009 | Kita et al. ..... 36/27 |
| 2002/0014022 | A1 | * | 2/2002 | Kita et al. ..... 36/28 |
| 2002/0174567 | A1 | | 11/2002 | Krafsur et al. |
| 2004/0068892 | A1 | | 4/2004 | Wang |
| 2006/0137227 | A1 | | 6/2006 | Kita et al. |
| 2006/0283045 | A1 | | 12/2006 | Kita et al. |

FOREIGN PATENT DOCUMENTS

| | | |
|---|---|---|
| JP | 2003-339405 | 12/2003 |

OTHER PUBLICATIONS

Nigg, Benno M., "Impact forces in running", Basic Sciences, 1997, Rapid Science Publishers, pp. 43-47.
Nigg, B. M. et al., "The effect of material characteristics of shoe soles on muscle activation and energy aspects during running", Journal of Biomechanics, Vo. 36, 2003, Elsevier Science Ltd, pp. 569-575.
Marriott, Michel, "The Bionic Running Shoe", New York Times, May 6, 2004, 5 pages.
Gromer, Cliff, "Supercharged Shoes", PopularMechanics.com, Jul. 2003, pp. 81-85.
"Stability", Runner's World, Jun. 2004, p. 80.
"Spring-loaded running shoes get shocking", inside Triathlon, Jun. 2004, pp. 24-25.
Outside Buyer's Guide, 2003 Annual, 2 pages.
Shoe Buyer's Guide, Jun. 2003, pp. 43-56.
Hytrel® thermoplastic polyester elastomer, DuPont Automotive, Apr. 13, 2004, 1 page.
Nike Shox TL® Nike, Sep. 7, 2004, 1 page.
"The Future is Now WaveSpring™ Technology is here and it is coming to a shoe near you!" Spira Footwear, Sep. 7, 2004, 4 pages.
"Spring Shoe Review 2004", Running Network, Sep. 7, 2004, 46 pages.
Britek's Thrustor® technology, Britek Footwear, Sep. 7, 2004, 2 pages.

* cited by examiner

SOLE STRUCTURE FOR A SHOE

CROSS-REFERENCE TO RELATED APPLICATION

This application is a Continuation-In-Part of U.S. application Ser. No. 11/317,322 filed on Dec. 22, 2005, now U.S. Pat. No. 7,484,317 issued on Feb. 3, 2009, the entire disclosure of which is incorporated herein by reference.

BACKGROUND OF THE INVENTION

The present invention relates generally to a sole structure for a shoe, and more particularly, to an improvement in the sole structure for enhancing cushioning and bending properties of the heel portion of the sole.

Japanese patent application laying-open publication No. 2003-339405 shows a sole structure for a shoe to secure cushioning properties of the heel portion. In the sole structure, an upper plate and a lower plate are disposed on the upper side and the lower side, respectively, of a wavy plate that is disposed at the heel region.

In this case, a plurality of voids formed between the wavy plate and the upper and lower plate function as cushion holes to secure cushioning properties of the heel portion.

However, in the prior art structure shown in JP publication No. 2003-339405, since the upper convex portions and the lower convex portions of the wavy plate are fixedly attached to the upper plate and the lower plate, respectively, a vertical deformation of the wavy plate has been restricted at the time of striking onto the ground. Therefore, the prior art structure had the limitation on improvement in cushioning properties of the sole heel portion. Also, in the prior art structure, restriction on the deformation of the wavy plate has impeded the bending properties of the heel portion as well.

On the other hand, Japanese patent application laying-open publication No. 2003-9906 shows a sole structure for a shoe having an upper wavy sheet and a lower wavy sheet that are oppositely disposed via a void between an upper midsole and a lower midsole in the sole heel portion.

In this case, the void between the upper and lower wavy sheet functions as a cushion hole to secure the cushioning properties of the heel portion.

However, in the prior art structure shown in JP publication No. 2003-9906, since there are provided the upper midsole on the upper surface of the upper wavy sheet and the lower midsole on the lower surface of the lower wavy sheet, the upper and lower midsole restricts the vertical deformation of the wavy sheet at the time of impacting onto the ground. Therefore, the prior art structure had the limitation on improvement in cushioning properties of the sole heel portion. Also, in the prior art structure, restriction on the deformation of the wavy sheet has impeded the bending properties of the heel portion as well.

An object of the present invention is to provide a sole structure for a shoe that can improve bending properties as well as cushioning properties of the sole heel portion.

SUMMARY OF THE INVENTION

A sole structure for a shoe according to a first aspect of the present invention includes an upper plate disposed on the upper side of the heel region of the sole structure, a wavy lower plate disposed on the lower side of the heel region and having at least two convex portions that protrude downwardly and that form a void relative to the upper plate, and a plurality of outsole portions separated in the longitudinal direction and fitted to the lower surface of the convex portions of the lower plate.

According to the first aspect of the present invention, at the time of striking onto the ground, the lower surface of the convex portions of the lower plate contacts the ground through the outsole portions. At this time, the void formed between the upper and lower plate acts as a cushion hole to display cushioning properties of the heel portion. Moreover, in this case, since the longitudinally separated outsole portions are directly fitted to the lower surfaces of the convex portions of the wavy lower plate, deformation of the convex portions of the wavy lower plate is not restricted at the time of striking onto the ground, thereby enhancing the cushioning properties of the sole heel portion. Also, by securing the deformation of the wavy lower plate, bending properties of the sole heel portion is improved. As a result, when a shoe wearer impacts the ground on the rear end of the sole heel portion and the load transfers in the forward direction, a "ride feeling" can be improved.

Here, FIG. 8 shows the result of an impact test of the sole structure of the first aspect of the present invention and the prior art sole structure shown in FIG. 3 of JP publication No. 2003-9906.

In this impact test, a weight of 10 kg falls down from the height of 60 mm onto each of the sole structures, and thereafter, the amount of deformation of each of the sole structures is measured. The thickness of each of the sole structures before falling of the weight is 30 mm, and a hit area on each of the sole structures is 15.9 $cm^2$.

The amount of deformation of each of the sole structures after the weight falls thereon is 18.02 mm for the sole structure of the present invention and 14.38 mm for the prior art sole structure. In other words, the amount of deformation of the first aspect of the present invention is 125.3 in the case where the amount of deformation of the prior art structure is 100. That is, the deformation of the present invention is about 1.25 times greater than that of the prior art structure.

In addition, a shoe wearer can sense the difference in the cushioning properties if the deformation is 110 relative to 100 in the prior art structure. Therefore, if the deformation is 125.3 as in the present invention, the difference in the cushioning properties is remarkable.

A sole structure for a shoe according to a second aspect of the present invention includes an upper plate disposed on the upper side of the heel region of the sole structure, a wavy lower plate disposed on the lower side of the heel region and having at least two convex portions that protrude downwardly and that form a void relative to the upper plate, and a plurality of cleats provided on the lower surface of the convex portions of the lower plate.

According to the second aspect of the present invention, at the time of striking onto the ground, first, the cleats stick into the ground and then, the lower surface of the convex portions of the lower plate contacts the ground. At this time, the void formed between the upper and lower plate acts as a cushion hole to display cushioning properties of the heel portion. Moreover, in this case, since the cleats are provided on the lower surfaces of the convex portions of the wavy lower plate, deformation of the convex portions of the wavy lower plate is not restricted at the time of striking onto the ground, thereby enhancing the cushioning properties of the sole heel portion. Also, by securing the deformation of the wavy lower plate, bending properties of the sole heel portion is improved.

Here, FIG. 12 shows the result of an impact test of the sole structure of the second aspect of the present invention and the prior art sole structure shown in FIG. 11, The prior art sole structure 100 shown in FIG. 11 differs from the second aspect of the present invention (see FIG. 9A) in that an upper plate is not provided above the lower plate 3 to form the void with the lower plate 3.

In this impact test, as with the first aspect of the present invention, a weight of 10 kg falls down from the height of 60 mm onto each of the sole structures, and thereafter, the amount of deformation of each of the sole structures is measured. The thickness of each of the sole structures before falling of the weight is 20 mm, and a hit area on each of the sole structures is 15.9 $cm^2$.

The amount of deformation of each of the sole structures after the weight falls thereon is 13.0 mm for the sole structure of the second aspect of the present invention and 11.3 mm for the prior art sole structure. In other words, the amount of deformation of the present invention is 115.0 in the case where the amount of deformation of the prior art structure is 100. That is, the deformation of the present invention is about 1.15 times greater than that of the prior art structure.

In addition, a shoe wearer can sense the difference in the cushioning properties if the deformation is 110 relative to 100 in the prior art structure. Therefore, if the deformation is 115.0 as in the present invention, the difference in the cushioning properties is remarkable.

A sole structure for a shoe according to a third aspect of the present invention includes an upper plate disposed on the upper side of the heel region of the sole structure, a wavy lower plate disposed on the lower side of the heel region and having at least two convex portions that protrude downwardly and that form avoid relative to the upper plate, and a cleat provided between the adjacent convex portions of the lower plate.

According to the third aspect of the present invention, at the time of striking onto the ground, first, the cleats stick into the ground and then, the lower surface of the convex portions of the lower plate contacts the ground. At this time, the void formed between the upper and lower midsole acts as a cushion hole to display cushioning properties of the heel portion. Moreover, in this case, since the cleat is provided between the adjacent convex portions of the lower plate, deformation of the convex portions of the wavy lower plate is not restricted at the time of striking onto the ground, thereby enhancing the cushioning properties of the sole heel portion. Also, by securing the deformation of the wavy lower plate, bending properties of the sole heel portion is improved.

In addition, the result of an impact test of the sole structure of the third aspect of the present invention is omitted here. However, as with the first and second aspect of the present invention, when an impact load is applied the void formed between the upper and lower plate acts as a cushion hole to display cushioning properties of the heel portion. Therefore, it is presumed that the numerical value in which the shoe wearer can feel the difference of the cushioning properties similar to the first and second aspect of the present invention will be obtained.

The upper plate constituting the sole structure of the present invention may have a wavy shape. In this case, deformation of the wavy upper plate further improves the cushioning properties of the sole heel portion.

Also, the upper plate may have a convex portion that protrudes in the direction opposite the protruding direction of the convex portion of the lower plate and that is located at a position corresponding to the convex portion of the lower plate. In this case, a large void can be secured between the upper and lower plate to further enhance the cushioning properties of the sole heel portion. In addition, the upper plate may have a convex portion that protrudes in the same direction as the protruding direction of the convex portion of the lower plate and that is located at a position corresponding to the convex portion of the lower plate.

Preferably, there is provided an elastic block member as a cushioning member between the upper and lower plate, and the upper plate and the lower plate are connected to each other through the elastic block member. Suitable adjustment of elasticity of the elastic block member can further improve the cushioning properties of the sole heel portion.

In the case of the wavy upper plate, the downwardly protruding convex portion of the wavy configuration of the upper plate may be coupled through the elastic block to the upwardly protruding convex portion between the adjacent convex portions of the lower plate.

The upwardly protruding convex portion of the lower plate and the downwardly protruding convex portion of the upper plate are disposed oppositely to each other in the vertical direction, or disposed offset in the longitudinal direction.

The number of convex portions of the lower plate may be varied between the medial side and the lateral side of the sole structure.

The upper plate may be flat in shape. In this case, since a flat surface is secured on the upper surface of the upper plate, a foot contact surface for a shoe wearer can be easily obtained without providing a midsole on the upper side of the upper plate.

A midsole of a soft elastic material may be provided on the upper side of the upper plate to attain an improved favorable touch to the sole of a wearer's foot.

The longitudinally adjacent outsole portions may be connected to each other though a connection in the longitudinal direction. At this juncture, the lower surface of the connection is preferably concave shaped.

In this case, by connecting the outsole portions through the connection, the outsole portions can be integrated with each other to improve the efficiency of assembly. Also, in this case, since the lower surface of the connection is formed concave, the connection does not restrict the compressive deformation of the convex portion of the lower plate.

The outsole portions may be separately disposed on the medial side and the lateral side of the heel portion. At this juncture, the outsole portions on the medial side may be connected to each other in the longitudinal direction and the outsole portions on the lateral side may be connected to each other in the longitudinal direction. Also, the lower surface of the connection on the lateral side may have a concave shape and the lower surface of the connection on the medial side may have a flat shape to contact the ground.

In this case, the deformation of the convex portion of the lower plate on the medial side of the heel region is more restricted than the deformation of the convex portion of the lower plate on the lateral side. As a result, pronation can be prevented at the time of striking onto the ground and the sole structure suitable for a running shoe can thus be achieved.

On the other hand, in the case where the outsole portions are separately disposed on the medial side and the lateral side of the heel portion, the outsole portions on the medial side may be connected to each other in the longitudinal direction and the outsole portions on the lateral side may be connected to each other in the longitudinal direction, and the lower surface of the connection on the medial side may have a concave shape and the lower surface of the connection on the lateral side may have a flat shape to contact the ground.

In this case, the deformation of the convex portion of the lower plate on the lateral side of the heel region is more restricted than the deformation of the convex portion of the lower plate on the medial side. As a result, supination can be prevented at the time of sidestepping and the sole structure suitable for an indoor shoe such as a tennis shoe or basketball shoe can thus be achieved.

A longitudinally extending rib may be integrated with the upper pate or the lower plate. Since provision of a rib increases the bending rigidity of the upper or lower plate, deformation of the upper or lower plate is restrained, and the bending and cushioning properties can be adjusted.

The rib may be formed either on the medial side or the lateral side of the upper or lower midsole. In the case where the rib is provided on the medial side of the plate, pronation at the time of impacting the ground can be prevented and the sole structure suited for a running shoe can be proposed. In the case where the rib is provided on the lateral side of the plate, supination at the time of sidestepping can be prevented and the sole structure suited for an indoor shoe such as a tennis shoe or a basketball shoe can be proposed.

The number of ribs may be different between the medial side and the lateral side of the upper or lower plate. In this case, since the bending rigidity of the plate is made greater on the side with more ribs than the other side, by increasing the number of ribs on the medial side, a sole structure suitable for a running shoe can be attained. Alternatively, by increasing the number of ribs on the lateral side, a sole structure suitable for indoor sports can be attained.

A longitudinally extending rib may be integrally formed with the lower plate and at this juncture the rib may be disposed only at the position corresponding to the outsole portion and may not be disposed at the region where no outsole portion is provided. Also, in the case where the cleat is provided on the lower surface of the convex portion of the lower plate, the rib may be disposed only at the position corresponding to the cleat and may not be disposed at the region where no cleat is provided. Moreover, in the case where the cleat is provided between the adjacent convex portions of the lower plate, the rib may be disposed only at the position corresponding to the convex portion and may not be disposed between the adjacent convex portions. In these cases, at the time of impacting the ground, the rib can be prevented from excessively restricting the deformation of the wavy lower plate.

According to the present invention, since the upper plate and the wavy lower plate are disposed in the sole heel portion with the void formed therebetween and a plurality of longitudinally separated outsole portions are attached on the lower surface of the convex portions of the lower plate, or the cleats are provided on the lower surface of the convex portions of the lower plate, or the cleat is provided between the adjacent convex portions of the lower plate, the deformation of the convex portions of the wavy lower plate is not restricted at the time of striking onto the ground, thereby improving the cushioning and bending properties.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1A:
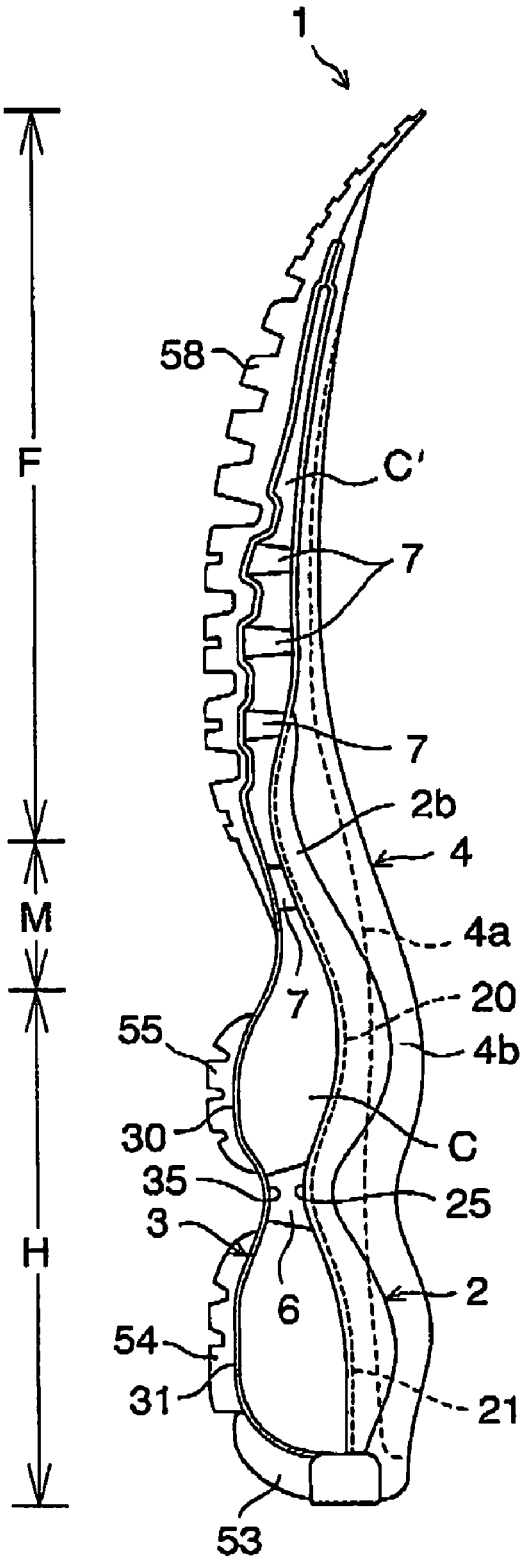
FIG. 1A is a side view on the lateral side of a sole structure according to a first embodiment of the present invention.
Figure 1B:
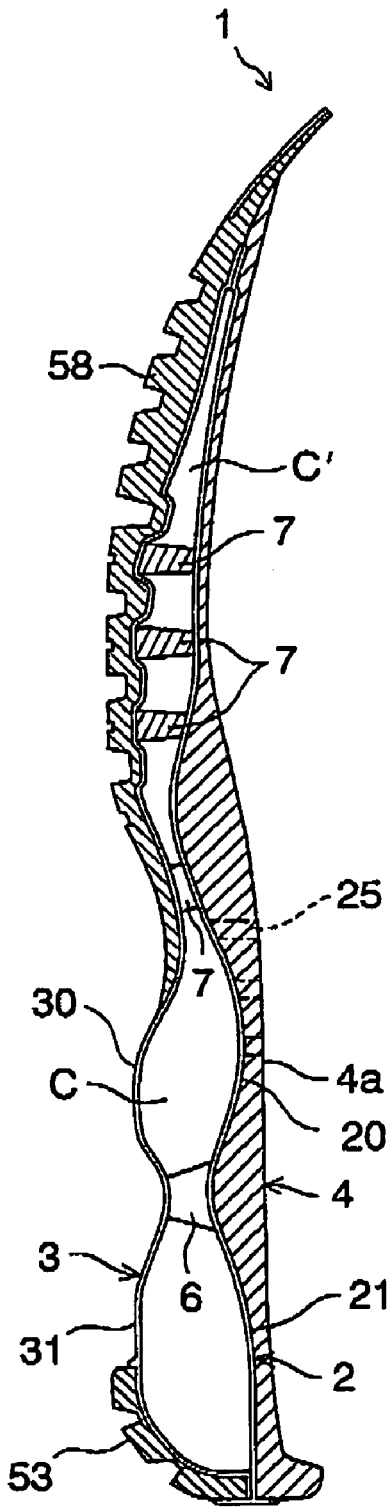
FIG. 1B is a longitudinal sectional view of the sole structure of FIG. 1A along the centerline, corresponding to a section of line IB-IB of FIG. 2.

Referring now to the drawings. FIGS. 1A and 1B show a sole structure or a sole assembly according to a first embodiment of the present invention. As shown in FIGS. 1A and 1B, a sole structure 1 includes an upper plate 2 extending from a heel portion H through a midfoot portion M to the forefoot portion F of the sole structure 1, and a lower plate 3 disposed below the upper plate 2 and extending from the heel portion H through the midfoot portion M to the forefoot portion F similar to the upper plate 2. Both of the upper plate 2 and the lower plate 3 extend in the shoe width direction, and the front end edges of the plates 2, 3 are coupled to each other and rear end edges of the plates 2, 3 are also coupled to each other.

The upper plate 2 has wavy configurations that progress longitudinally in the heel portion H and that have two convex portions 20, 21 each protruding upwardly. The lower plate 3 has wavy configurations that progress longitudinally in the heel portion H similar to the upper plate 2 and that have two convex portions 30, 31 each protruding downwardly. The corresponding convex portions 20, 30 and 21, 31 of the upper and lower plate 2, 3 in the heel portion H are oppositely disposed in the vertical direction. In other words, the convex portions 20, 30 protrude in the opposite directions. Similarly, the convex portions 21, 31 protrude in the opposite directions. Between the corresponding convex portions 20 and 30 is formed a void C and also between the corresponding convex portions 21 and 31 is formed a void C. Additionally, in the forefoot portion F as well, a void C' is formed between the upper plate 2 and the lower plate 3.

Figure 2:
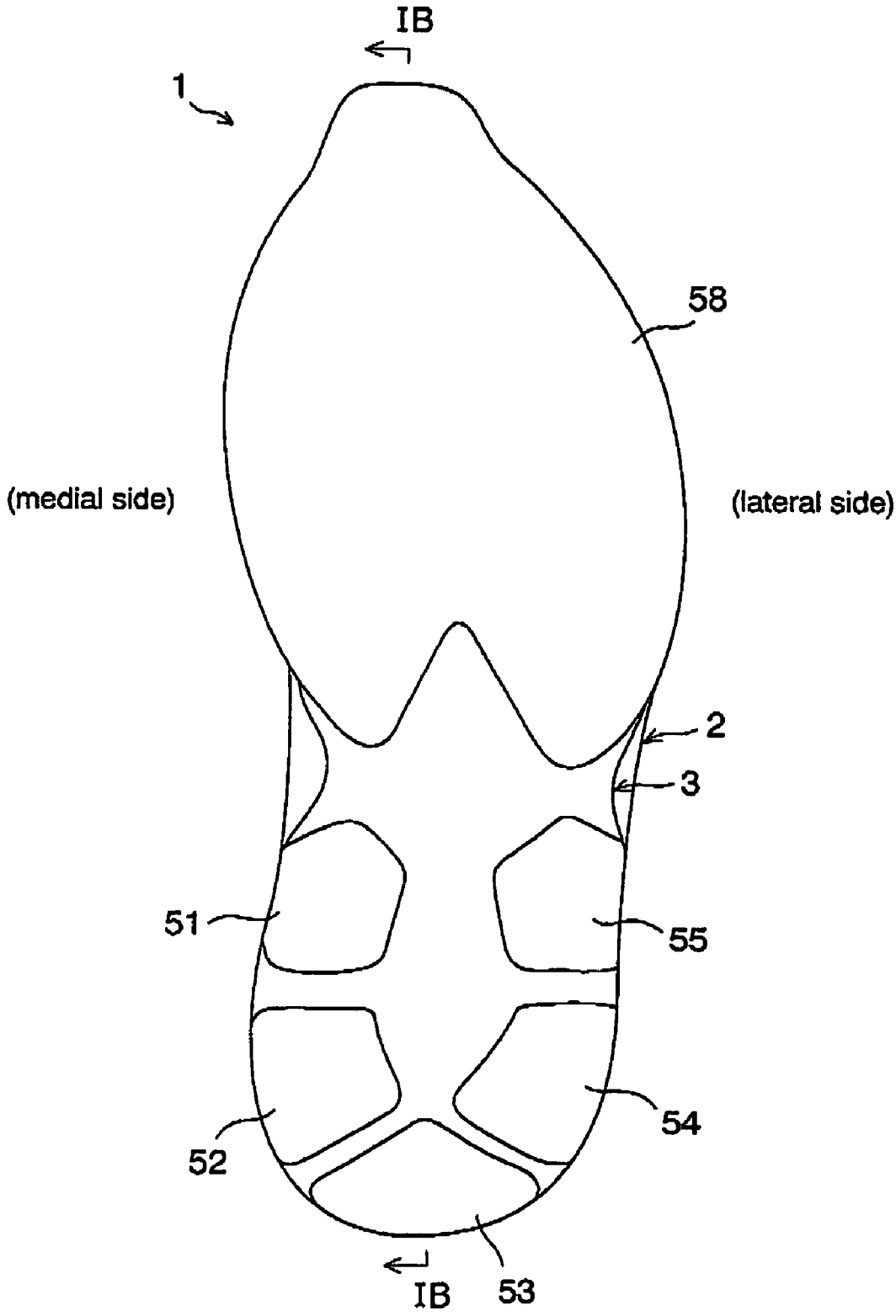
FIG. 2 is a bottom schematic view of the sole structure of FIG. 1A.

As shown in FIG. 2, a plurality of longitudinally separated outsole portions 51-55 are attached on the bottom surface of the lower plate 3. The outsole portions 51, 55 are disposed on the lower surface of the convex portion 30 of the lower plate 3, and the outsole portions 52, 54 and a portion of 53 are disposed on the lower surface of the convex portion 31 of the lower plate 3, as shown in FIG. 1A. Also, in this example, the outsole portions 51, 55 are separated in the shoe width direction and similarly, the outsole portions 52, 54 are separated in the shoe width direction.

Turning back to FIG. 1A, a pair of upwardly extending upraised portions 2*b* are formed on opposite side edge portions of the upper plate 2. On the upper surface of the upper plate 2 is attached a midsole 4 that extends from the heel portion H through the midfoot portion M to the forefoot portion F. The midsole 4 has a generally flat foot sole contact surface 4*a* that contacts the foot sole of the shoe wearer, and a pair of upraised portions 4*b* that extend upwardly and that are disposed on opposite side edge portions of the foot sole contact surface 4*a*. The upraised portions 2*b* of the upper plate 2 are disposed on the outside of the upraised portions 4*b* of the midsole 4. The upraised portions 4*b* of the midsole 4 are adapted to be fixedly attached to a bottom portion of a shoe upper (not shown).

An elastic block member 6 is disposed between the upper plate 2 and the lower plate 3 at the position where the upper and lower plate 2, 3 are most close to each other in the heel portion H. The upper plate 2 is coupled to the lower plate 3 through the elastic block 6. In other words, the downwardly convex portion 25 formed between the adjacent upwardly convex portions 20 and 21 of the upper plate 2 and the upwardly convex portion 35 formed between the adjacent downwardly convex portions 30 and 31 of the upper plate 3 are disposed opposite each other in the vertical direction, and these oppositely disposed portions are connected to each other through the elastic block 6.

The elastic block 6 is, in this embodiment, formed of a pair of members disposed on opposite side ends of the heel portion H (see FIG. 1B, a longitudinal sectional view, in which the side surface of one of the elastic blocks 6 is shown), but the elastic block 6 may be formed of only one member extending along the entire width of the heel portion H. The elastic block 6 is provided mainly for preventing the upper and lower plate 2, 3 from directly contacting each other, but it also helps improve the cushioning properties of the sole heel portion by selectively adjusting its elasticity.

The upper and lower plates 2, 3 are preferably formed of a hard plastic resin in order to prevent loss of elasticity due to repetitive deformation to maintain the shape of the void C to some degree between the plates 2 and 3. For example, the upper and lower plates 2, 3 may be formed of thermoplastic resin such as thermoplastic polyurethane (TPU), polyamide elastomer (PAE), ABS resin or the like. Alternatively, the upper and lower plates 2, 3 may be formed of thermosetting resin such as epoxy resin, unsaturated polyester resin or the like. Also, the upper and lower plates 2, 3 may be formed of fiber reinforced plastics including carbon fibers or metal fibers.

The midsole 4 is preferably formed of the soft elastic material to contact and support the sole of a shoe wearer. For example, foamed thermoplastic resin such as ethylene-vinyl acetate copolymer (EVA), foamed thermosetting resin such as polyurethane (PU), and foamed rubber such as butadiene rubber or chloroprene rubber may be used.

As shown in FIG. 1B, a plurality of vent holes 25 are formed that extend vertically through the upper plate 2 and the midsole 4 disposed above the upper plate 2. The lower ends of the vent holes 25 are open into the void C formed between the upper plate 2 and the lower plate 3. By forming such vent holes 25, introduction of the open air into the inside of the shoe is carried out through the void C between the upper plate 2 and the lower plate 3, thereby facilitating and hastening the introduction of the open air.

In the forefoot portion F and the midfoot portion M, the upper plate 2 and the lower plate 3 are coupled to each other through the elastic block 7, as shown in FIG. 1A. Also, in the forefoot portion F, an outsole 58 is bonded onto the bottom surface of the lower plate 3.

According to the above-mentioned sole structure, at the time of striking onto the ground, the lower surface of the convex portions 30, 31 of the lower plate 3 contacts the ground through the outsole portions. At this time, the void C formed between the upper plate 2 and the lower plate 3 acts as a cushion hole to display cushioning properties of the heel portion H. Moreover, in this case, since the longitudinally separated outsole portions 51-55 are directly attached to the lower surfaces of the downwardly convex portions 30, 31 of the wavy lower plate 3, compressive deformation of the downwardly convex portions 30, 31 of the wavy lower plate 3 is not restricted at the time of impacting the ground and the cushioning properties of the sole heel portion can thus be improved. Also, in this case, by securing the deformation of the wavy lower plate 3, bending properties of the sole heel portion can be enhanced. Thereby, a "ride feeling" can be improved when the shoe wearer impacts the ground on the rear end of the sole heel portion and the load travels in the forward direction.

Furthermore, in this case, since the corresponding convex portions 20, 30 between the upper and lower plate 2, 3 protrude in the opposite direction and the corresponding convex portions 21, 31 between the upper and lower plate 2, 3 protrude in the opposite direction, a large void C can be secured between the upper and lower plate 2, 3 and the cushioning properties of the sole heel portion can be further improved. Also, since the upper plate 2 is in the shape of a wavy corrugation, deformation of the upper plate 2 also helps improve the cushioning properties of the sole heel portion.

The corresponding convex portions 20, 30 between the upper and lower plate 2, 3 may protrude in the same direction and the corresponding convex portions 21, 31 between the upper and lower plate 2, 3 may protrude in the same direction. At this juncture, in order to secure a void C between the upper plate 2 and the lower plate 3, the radius of curvature of the convex portions 20 is preferably different from the radius of curvature of the convex portions 30 and/or the radius of curvature of the convex portions 21 is preferably different from the radius of curvature of the convex portions 31. In the alternative, the corresponding convex portions between the upper plate 2 and the lower plate 3 may be offset in the longitudinal direction.

In the above-mentioned first embodiment, an example in which the lower plate 3 has two convex portions 30, 31 was shown, but the application of the present invention is not limited to such example. The lower plate 3 may have more than three convex portions. Also, in the above-mentioned first embodiment, an example in which the number of convex portions (i.e. two) on the medial side of the upper and lower plate 2, 3 is the same as the number of convex portions (i.e. two) on the lateral side of the upper and lower plate 2, 3, but the application of the present invention is not limited to such example. The number of convex portions on the medial side may be different from that on the lateral side: e.g. two convex portions on the medial side and three convex portions on the lateral side.

Also, the first embodiment showed the upper plate 2 having a wavy corrugation in the heel portion H, but in the application of the present invention, the upper plate 2 may be flat in the heel portion H. In this case, since a flat surface is secured on the upper surface of the upper plate 2, a foot contact surface for the shoe wearer can be easily obtained without providing a midsole on the upper side of the upper plate 2.

In the above-mentioned first embodiment, the elastic block may be omitted. In this case, the upper and lower plate 2, 3 need not to be coupled to each other at the position where the elastic block was provided. A clearance may be formed between the upper plate 2 and the lower plate 3. In the case where the upper plate 2 and the lower plate 3 are coupled to each other, the upper and lower plate 2, 3 can be integrally formed, thereby simplifying the manufacturing process and the assembly process.

Figure 3:
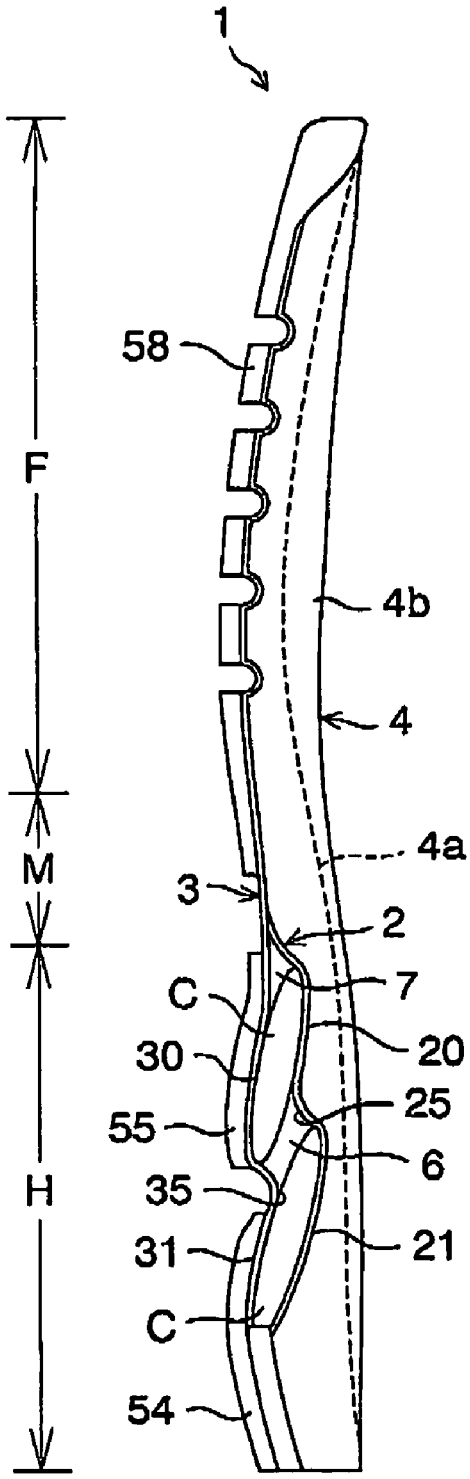
FIG. 3 is a side view on the lateral side of a sole structure according to a second embodiment of the present invention.

FIG. 3 shows a sole structure according to a second embodiment of the present invention. In FIG. 3, like reference numbers indicate identical or functionally similar elements.

In the above-mentioned first embodiment, the upwardly convex portion 35 between the adjacent downwardly convex portions 30, 31 of the lower plate 3 is positioned against the downwardly convex portion 25 between the adjacent upwardly convex portions 20, 21 of the upper plate 2, whereas in the second embodiment, these convex portions 25, 35 are disposed offset in the longitudinal direction. Preferably, as shown in FIG. 3, the downwardly convex portion 25 of the upper plate 2 is disposed in front of the upwardly convex portion 35 of the lower plate 3. An elastic block 6 connecting the downwardly convex portion 25 of the upper plate 2 with the upwardly convex portion 35 of the lower plate 3 extends obliquely upwardly from the lower plate 3 to the upper plate 2.

In this case, at the time of striking onto the ground, the elastic block 6 shear-deforms as well as bending-deforms. At this juncture, the placement of the convex portion 25 of the upper plate 2 in front of the convex portion 35 of the lower plate 3 facilitates the downward deformation of the upper plate 2, thereby further improving the cushioning properties of the sole heel portion.

Additionally, in the second embodiment, the upper plate 2 does not extend to the forefoot portion F, but it is disposed mainly at the heel portion H and its front end portion is fixedly attached to the lower plate 3 at the midfoot portion M.

Figure 4:
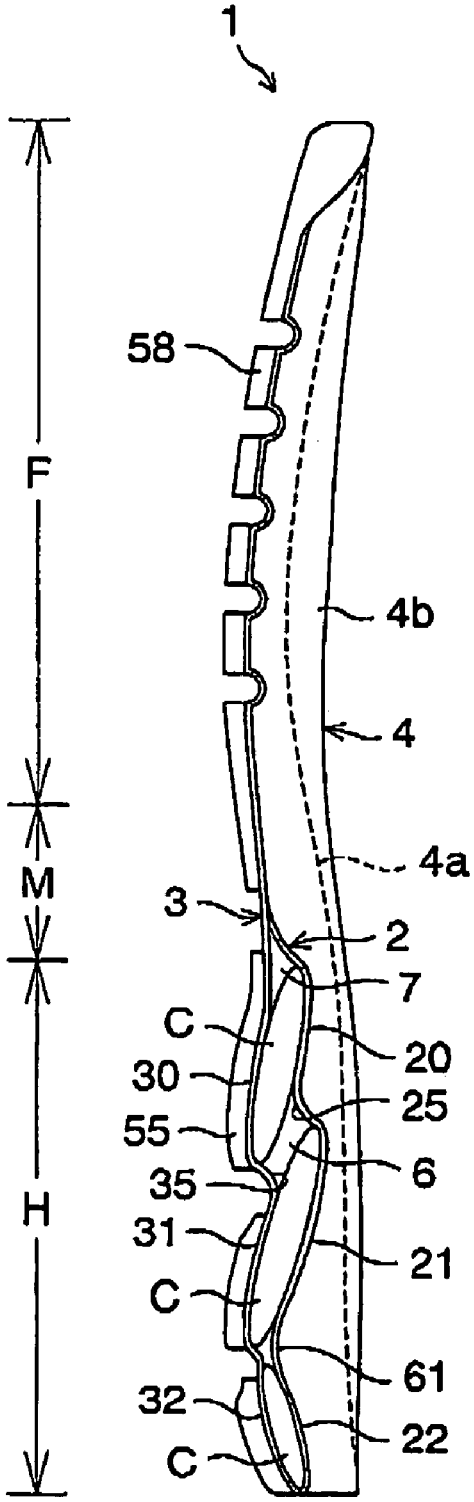
FIG. 4 is a side view on the lateral side of a sole structure according to a third embodiment of the present invention.

FIG. 4 shows a third embodiment of the present invention. In FIG. 4, like reference numbers indicate identical or functionally similar elements.

This third embodiment differs from the second embodiment in that the upper and lower plate 2, 3 has a third convex portion 22, 32, respectively. The convex portions 22, 32 protruding in the opposite directions are contraposed in the vertical direction, and a third void C is formed between the convex portions 22, 32. The upwardly convex portion between the adjacent downwardly convex portions 31, 32 of the lower plate 3 is disposed opposite the downwardly convex portion between the adjacent upwardly convex portions 21. 22 of the upper plate 2. These oppositely disposed portions are connected to each other through the elastic block 61.

In this case, by forming the void C at the heel rear end portion, when impacting the ground on the heel rear end portion, downward deformation of the upper plate 2 becomes much easier, thereby further improving the cushioning properties of the sole heel portion.

Figure 5:
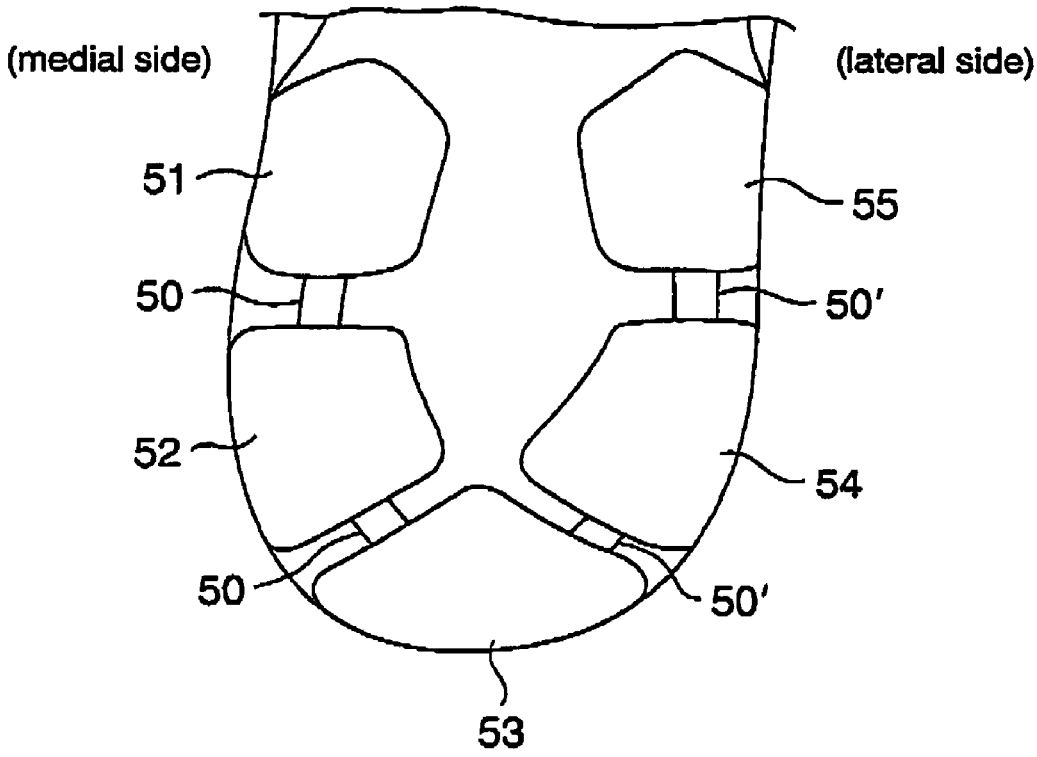
FIG. 5 is a partial bottom view of a sole structure according to a fourth embodiment of the present invention.
Figure 6:
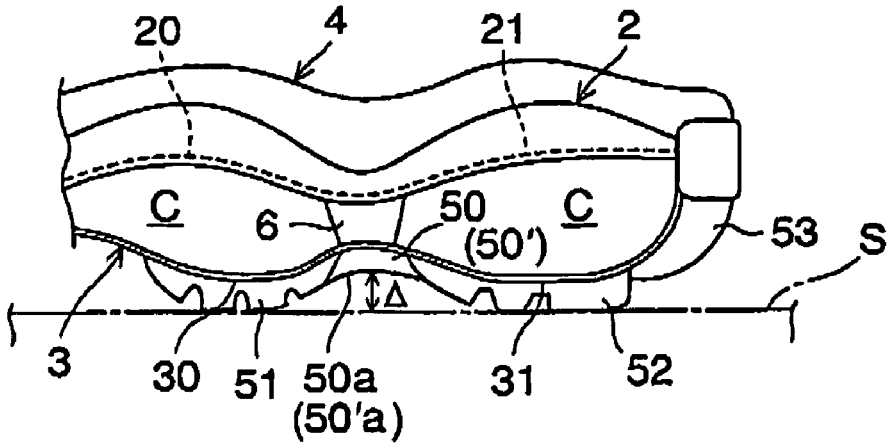
FIG. 6 is a partial side view of the sole structure of FIG. 5.

FIGS. 5 and 6 show a sole structure of a fourth embodiment of the present embodiment. In FIGS. 5 and 6, like reference numbers indicate identical or functionally similar elements.

As shown in FIG. 5, the fourth embodiment differs from the first to third embodiments in that the outsole portions are longitudinally connected to each other through the connections 50, 50'. The connections 50 are disposed on the medial side of the heel portion and the connections 50' are disposed on the lateral side of the heel portion. The connections 50, 50' are band-shaped members and each of the bottom surfaces 50*a*, 50'*a* of the connections 50, 50' is concave in shape to form a clearance Δ between the bottom surfaces 50*a*, 50'*a* and the ground surface S when the sole heel portion is in contact with the ground surface S, as shown in FIG. 6.

In this case, since the outsole portions 50-55 are connected to each other via the connections 50, 50' in the longitudinal direction, the outsole portions can be integrated with each other. Thereby, during assembly, the outsole portions 50-55 can be bonded to the bottom surface of the lower plate 3 at one time. As a result, mis-bonding can be prevented and the assembly accuracy can be improved. Also, in this case, since the connections 50, 50' have concave bottom surfaces 50*a*, 50'*a*, the connections 50, 50' do not restrict the compressive deformation of the convex portions 30, 31 of the lower plate 3. Therefore, in this embodiment as well, cushioning and bending properties of the sole heel portion can be improved similarly to the first embodiment.

In the above-mentioned fourth embodiment, both of the connections 50, 50' have concave bottom surfaces 50*a*, 50'*a*, but the present invention is not limited to such an example.

In this fifth embodiment, only the bottom surface 50'*a* of the connection 50' disposed on the lateral side is concave in shape as with the fourth embodiment, whereas the bottom surface 50*a* of the connection 50 disposed on the medial side is flat in shape so as to be in contact with the ground surface S (see FIG. 6). Between the ground contact surface S and the lower surface 50*a* of the connection 50, a clearance Δ is not formed.

In this case, the deformation of the convex portions 30, 31 of the lower plate 3 on the medial side in the sole heel portion is more restrained than the deformation of the convex portions 30, 31 of the lower plate 3 on the lateral side in the sole heel portion. Thereby, pronation can be prevented and a sole structure suitable for a running shoe can thus be achieved.

In contrast to the fifth embodiment, according to a sixth embodiment, only the bottom surface 50*a* of the connection 50 disposed on the medial side is concave in shape as with the fourth embodiment, whereas the bottom surface 50'*a* of the connection 50' disposed on the lateral side is flat in shape so as to be in contact with the ground surface S (see FIG. 6). Between the ground contact surface S and the lower surface 50'*a* of the connection 50', a clearance Δ is not formed.

In this case, the deformation of the convex portions 30, 31 of the lower plate 3 on the lateral side in the sole heel portion is more restrained than the deformation of the convex portions 30, 31 of the lower plate 3 on the medial side in the sole heel portion. Thereby, supination can be prevented and a sole structure suitable for an indoor shoe such as a tennis shoe or a basketball shoe can thus be achieved.

Figure 7:
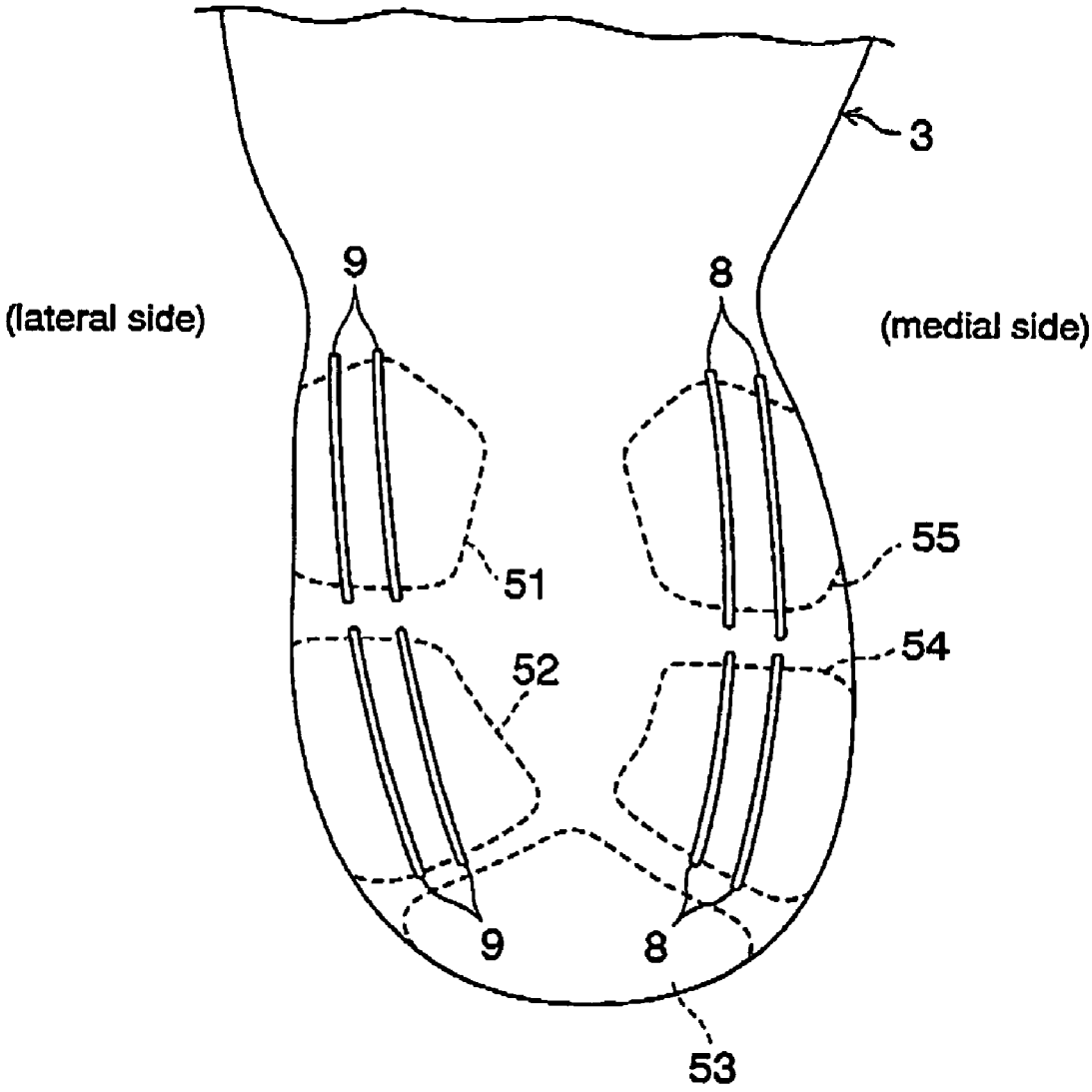
FIG. 7 is a partial top plan view of a lower plate constituting the sole structure according to a seventh embodiment of the present invention.
Figure 8:
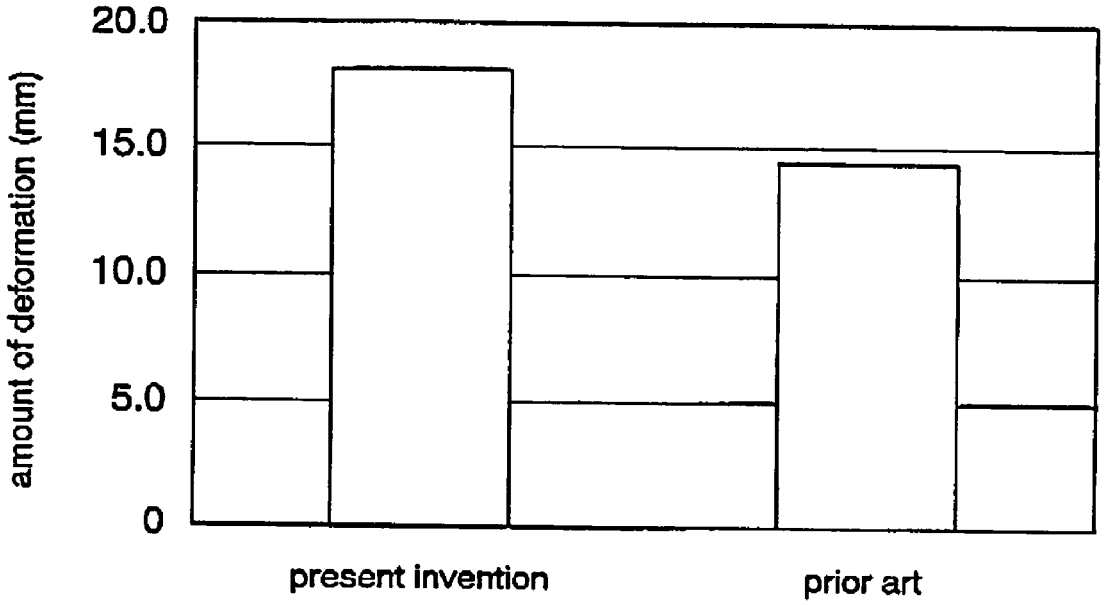
FIG. 8 is a graph showing the result of the impact test in which a weight falls from the predetermined height to exert an impact load to the sole structure of the present invention and the prior art sole structure shown in Japanese patent application laying-open publication No. 2003-9906, illustrating the difference of the amount of deformation in both the sole structures.

FIG. 7 shows a lower plate constituting a sole structure according to a seventh embodiment of the present invention. In this embodiment, a plurality of ribs 8, 9 extending in the substantially longitudinal direction are integrated with the upper surface of the lower plate 3.

The ribs 8 are provided on the medial side of the sole heel portion and the ribs 9 are provided on the lateral side of the sole heel portion. Also, the ribs 9 are disposed at the positions corresponding to the outsole portions 51, 52, respectively. The ribs 8 are disposed at the positions corresponding to the outsole portions 53, 54, respectively. There are no ribs provided between the longitudinally adjacent outsole portions 51, 52 and between the longitudinally adjacent outsole portions 54, 55.

In this case, the bending rigidity of the lower plate 3 is made higher at the portions where the ribs 8, 9 are provided than at the portions where the ribs 8, 9 are not provided. Thereby, the deformation of the lower plate 3 is more restricted at the portions where the ribs 8, 9 are provided than at the portions where the ribs 8, 9 are not provided. As a result, the bending and cushioning properties of the lower plate 3 can be adjusted. Also, in this case, the ribs 8, 9 are not provided between the outsole portions 51, 52 and between the outsole portions 54, 55, thereby preventing the deformation of the wavy lower plate 3 from being excessively restricted at the time of impacting the ground and preventing the cushioning and bending properties of the sole heel portion from being hindered.

Also, the number of ribs 8, 9 may be different between the medial side and the lateral side of the lower plate 3. Alternatively, a rib may be provided on either the medial side or the lateral side of the lower plate 3.

In the case where a rib is provided only on the medial side of the lower plate 3, or the number of the ribs 8 on the medial side is made larger than the number of the ribs 9 on the lateral side, pronation can be prevented at the time of impacting the ground and a sole structure suited for a running shoe can be attained. On the other hand, in the case where a rib is provided only on the lateral side of the lower plate 3, or the number of the ribs 9 on the lateral side is made larger than the number of the ribs 8 on the medial side, supination can be prevented at the time of sidestepping and a sole structure suited for an indoor shoe such as a tennis shoe, basketball shoe or the like can be attained. Additionally, the seventh embodiment showed the example in which the ribs are provided on the lower plate 3, but in the application of the present invention, the ribs maybe provided on the upper plate 2.

Figure 9A:
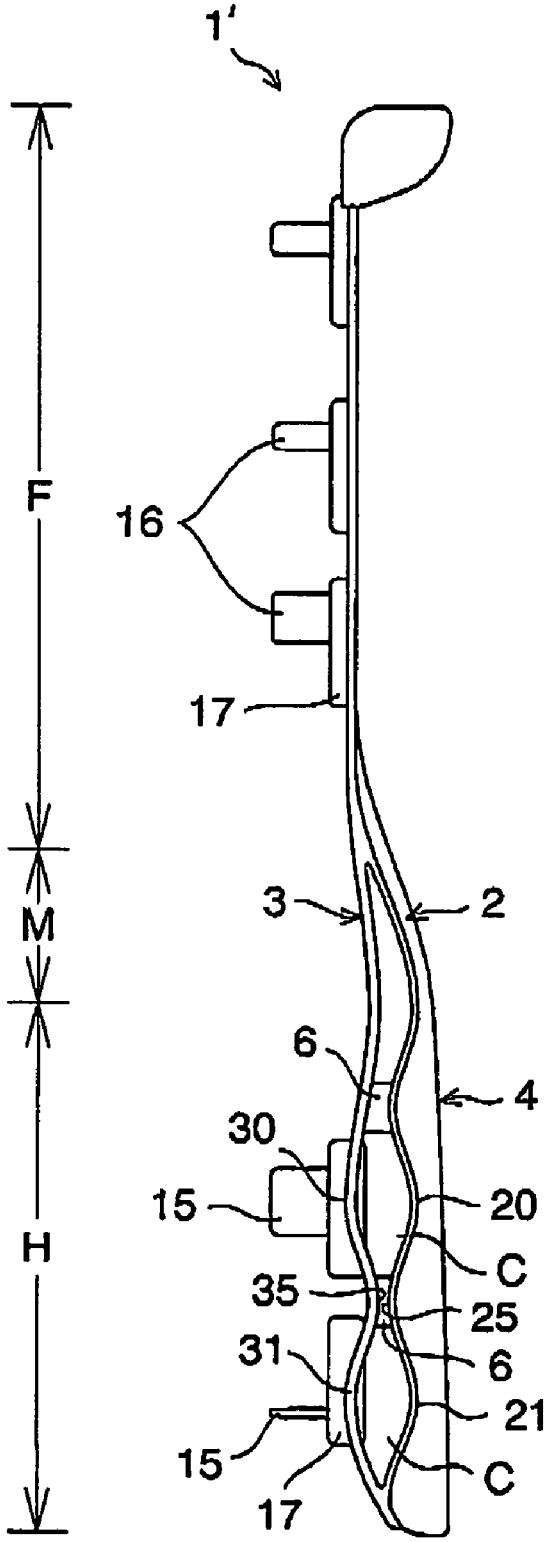
FIG. 9A is a side view of a sole structure according to an eighth embodiment of the present invention.

FIG. 9A shows a sole structure according to an eighth embodiment of the present invention. As shown in FIG. 9A, a sole structure 1' includes an upper plate 2 extending from a heel portion H to a midfoot portion M of the sole structure 1', and a lower plate 3 disposed below the upper plate 2 and extending from the heel portion H through the midfoot portion M to a forefoot portion F. The upper plate 2 is coupled to the lower plate 3 at the rear end of the heel portion H and at the front end of the midfoot portion M. Both of the upper plate 2 and the lower plate 3 extend in the shoe width direction.

The upper plate 2 has wavy configurations that progress longitudinally in the heel portion H and that have two convex portions 20, 21 each protruding upwardly. The lower plate 3 has wavy configurations that progress longitudinally in the heel portion H similar to the upper plate 2 and that have two convex portions 30, 31 each protruding downwardly. The corresponding convex portions 20, 30 and 21, 31 of the upper and lower plate 2, 3 in the heel portion H are oppositely disposed in the vertical direction. In other words, the convex portions 20, 30 protrude in the opposite directions. Similarly, the convex portions 21, 31 protrude in the opposite directions. Between the corresponding convex portions 20 and 30 is formed a void C and also between the corresponding convex portions 21 and 31 is formed a void C.

A plurality of cleats or studs 15, 16 are provided on the bottom surface of the lower plate 3. The cleat 15 is disposed at the region of the heel portion H, and the cleat 16 is disposed at the region of the forefoot portion F. The cleats 15, 16 are fixedly attached to the bottom surface of the lower plate 3 via a thick base portion or a pedestal 17. In the heel portion H, the base portions 17 and thus the cleats 15 are provided only on the bottom surface of the convex portions 30, 31 of the lower plate 3 and not between the convex portions 30 and 31. Therefore, the base portions 17 are separated in the heel portion H in the longitudinal direction. For example, the respective base portions 17 may be formed integrally with the lower plate 3. Alternatively, when the respective cleats 15 are composed of metal members, a portion thereof is embedded in and fixedly attached to the base portion 17.

On the upper surface of the upper plate 2 is attached a midsole 4 that extends from the heel portion H through the midfoot portion M to the rear end of the forefoot portion F.

An elastic block member 6 is disposed between the upper plate 2 and the lower plate 3 at the position where the upper and lower plate 2, 3 are most close to each other in the heel portion H. The upper plate 2 is coupled to the lower plate 3 through the elastic block 6. In other words, the downwardly convex portion 25 formed between the adjacent upwardly convex portions 20 and 21 of the upper plate 2 and the upwardly convex portion 35 formed between the adjacent downwardly convex portions 30 and 31 of the upper plate 3 are disposed opposite each other in the vertical direction, and these oppositely disposed portions are connected to each other through the elastic block 6.

The elastic block 6 is, in this embodiment, formed of a pair of members disposed on opposite side ends of the heel portion H, but the elastic block 6 may be formed of only one member extending along the entire width of the heel portion H. The elastic block 6 is provided mainly for preventing the upper and lower plate 2, 3 from directly contacting each other, but it also helps improve the cushioning properties of the sole heel portion by selectively adjusting its elasticity.

The upper and lower plates 2, 3 are preferably formed of a hard plastic resin in order to prevent loss of elasticity due to repetitive deformation to maintain the shape of the void C to some degree between the plates 2 and 3. For example, the upper and lower plates 2, 3 may be formed of thermoplastic resin such as thermoplastic polyurethane (TPU), polyamide elastomer (PAE), ABS resin or the like. Alternatively, the upper and lower plates 2, 3 may be formed of thermosetting resin such as epoxy resin, unsaturated polyester resin or the like. Also, the upper and lower plates 2, 3 may be formed of fiber reinforced plastics including carbon fibers or metal fibers.

The midsole 4 is preferably formed of the soft elastic material to contact and support the sole of a shoe wearer. For example, foamed thermoplastic resin such as ethylene-vinyl acetate copolymer (EVA), foamed thermosetting resin such as polyurethane (PU), and foamed rubber such as butadiene rubber or chloroprene rubber may be used.

According to the above-mentioned sole structure, at the time of striking onto the ground, first, the cleat 15 sticks into the ground and then, the lower surface of the convex portions 30, 31 of the lower plate 3 contacts the ground. At this time, the void C formed between the upper plate 2 and the lower plate 3 acts as a cushion hole to display cushioning properties of the heel portion H. Moreover, in this case, since the cleat 15 (and thus the base portion 17) is provided only on the lower surface of the convex portions 30, 31 of the wavy lower plate 3, compressive deformation of the downwardly convex portions 30, 31 of the wavy lower plate 3 is not restricted at the time of impacting the ground and the cushioning properties of the sole heel portion can thus be improved. Also, in this case, by securing the deformation of the wavy lower plate 3, bending properties of the sole heel portion can be enhanced.

Furthermore, in this case, since the corresponding convex portions 20, 30 between the upper and lower plate 2, 3 protrude in the opposite direction and the corresponding convex portions 21, 31 between the upper and lower plate 2, 3 protrude in the opposite direction, a large void C can be secured between the upper and lower plate 2, 3 and the cushioning properties of the sole heel portion can be further improved. Also, since the upper plate 2 is in the shape of a wavy corrugation, deformation of the upper plate 2 also helps improve the cushioning properties of the sole heel portion.

The corresponding convex portions 20, 30 between the upper and lower plate 2, 3 may protrude in the same direction and the corresponding convex portions 21, 31 between the upper and lower plate 2, 3 may protrude in the same direction. At this juncture, in order to secure a void C between the upper plate 2 and the lower plate 3, the radius of curvature of the convex portions 20 is preferably different from the radius of curvature of the convex portions 30 and/or the radius of curvature of the convex portions 21 is preferably different from the radius of curvature of the convex portions 31. In the alternative, the corresponding convex portions between the upper plate 2 and the lower plate 3 may be offset in the longitudinal direction.

In the above-mentioned eighth embodiment, an example in which the lower plate 3 has two convex portions 30, 31 was shown, but the application of the present invention is not limited to such example. The lower plate 3 may have more than three convex portions. Also, the present invention is not limited to an example in which the number of convex portions on the medial side of the upper and lower plate 2, 3 is the same as the number of convex portions on the lateral side of the upper and lower plate 2, 3, but the number of convex portions on the medial side may be different from that on the lateral side: e.g. two convex portions on the medial side and three convex portions on the lateral side.

Also, the eighth embodiment showed the upper plate 2 having a wavy corrugation in the heel portion H, but in the application of the present invention, the upper plate 2 may be flat in the heel portion H. In this case, since a flat surface is secured on the upper surface of the upper plate 2, a foot contact surface for the shoe wearer can be easily obtained without providing a midsole on the upper side of the upper plate 2.

In above-mentioned eighth embodiment, the elastic block may be omitted. In this case, the upper and lower plate 2, 3 need not to be coupled to each other at the position where the elastic block was provided. A clearance may be formed between the upper plate 2 and the lower plate 3. In the case where the upper plate 2 and the lower plate 3 are coupled to each other, the upper and lower plate 2, 3 can be integrally formed, thereby simplifying the manufacturing process and the assembly process.

Figure 9B:
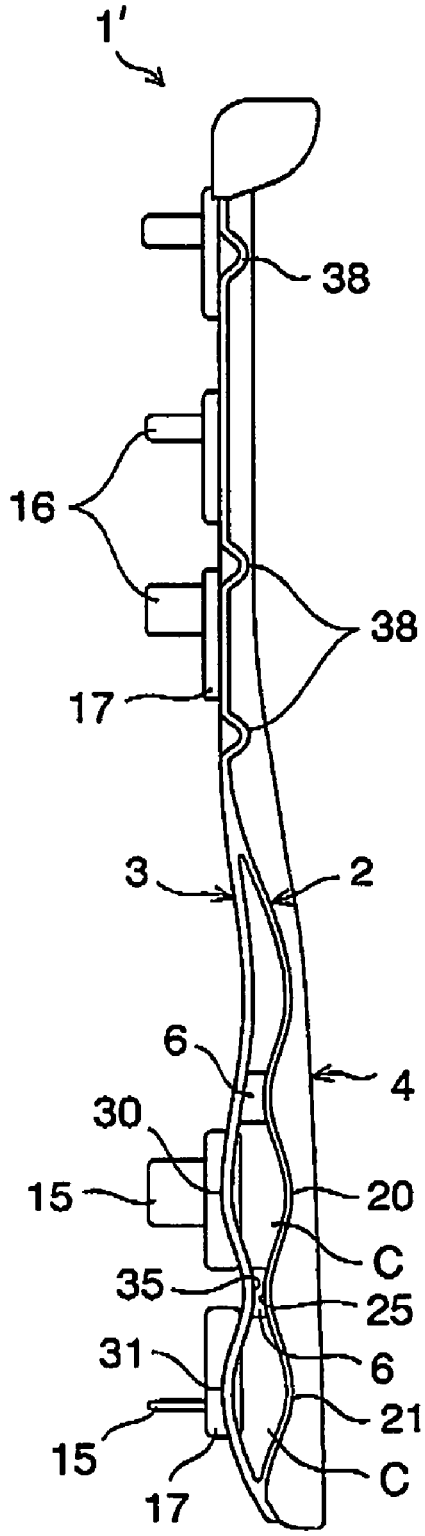
FIG. 9B is a variant of the sole structure of FIG. 9A.

FIG. 9B shows a variant of the eighth embodiment of the present invention. As shown in FIG. 9B, the variant is different from the eighth embodiment in that a plurality of U-shaped or V-shaped bent portions 38 are provided at the lower plate 3 in the forefoot portion F and the midsole 4 extends to the front end of the forefoot portion F. The respective bent portions 38 extend in the width direction of the forefoot portion F. In this case, not only cushioning properties of the sole heel portion can be secured as with the eighth embodiment but also bending properties of the sole forefoot portion can be improved by the bent portions 38.

Figure 9C:
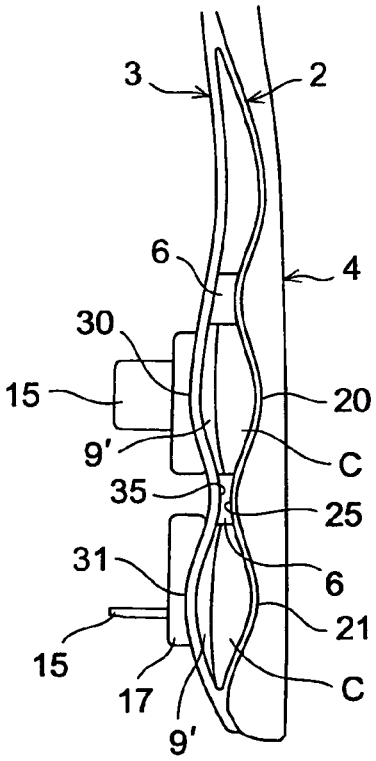
FIG. 9C is a partial side view similar to FIGS. 9A and 9B, showing a further variant with ribs like those of FIG. 7.
Figure 9D:
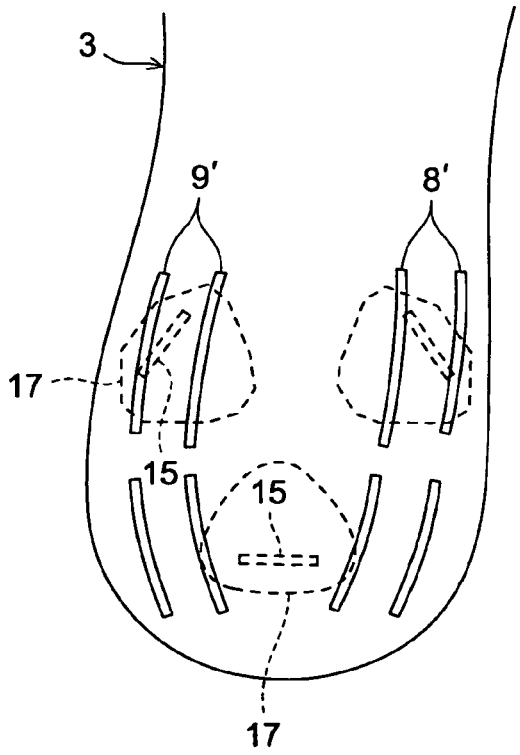
FIG. 9D is a partial top plan view similar to FIG. 7, showing the top surface of the lower plate with ribs in the sole structure according to FIG. 9C.

FIGS. 9C and 9D show a sole structure similar to FIGS. 9A and 9B, but according to a further variant having cleats 15 mounted on pedestals or bases 17 on the lower surface of the lower plate 3, as well as ribs 8' and 9' integrally formed with the upper surface of the lower plate 3 at positions corresponding to the downwardly convex portions 30 and 31.

Figure 10A:
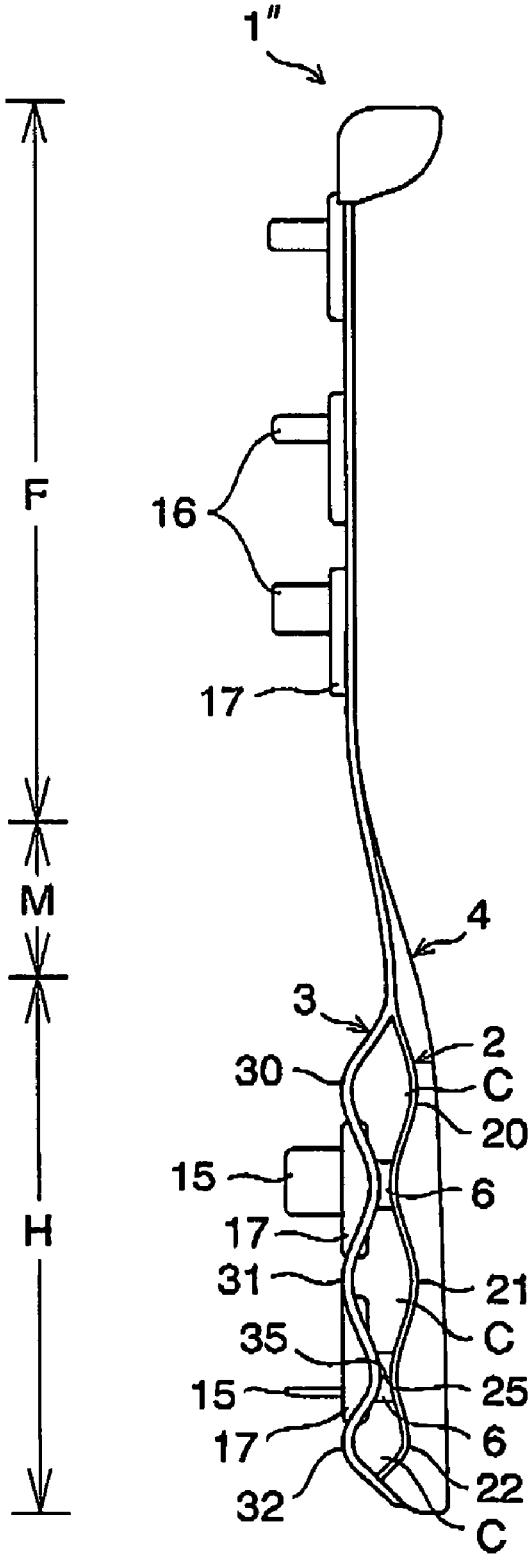
FIG. 10A is a side view of a sole structure according to a ninth embodiment of the present invention.
Figure 10B:
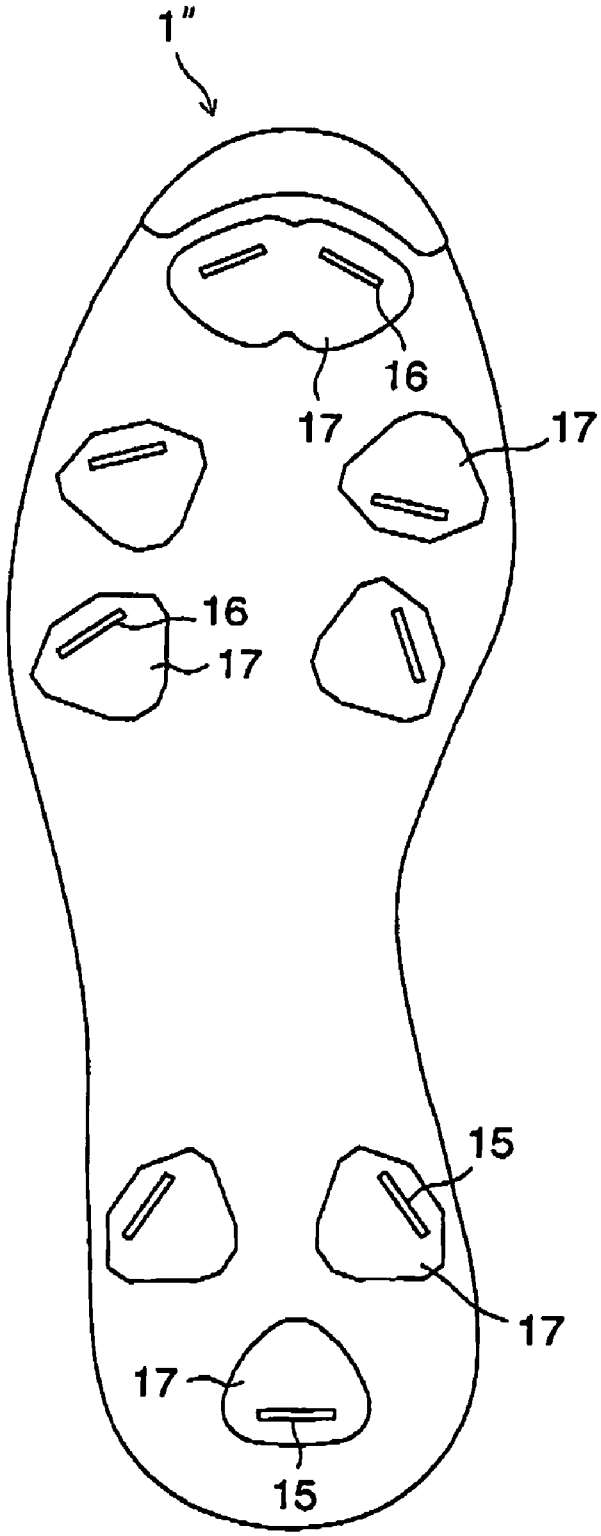
FIG. 10B is a bottom schematic view of the sole structure of FIG. 10A.

FIGS. 10A and 10B show a sole structure according to a ninth embodiment of the present invention. In these drawings, the same reference numbers as those in the eighth embodiment indicate identical or similar elements. The ninth embodiment differs from the eighth embodiment in that the lower plate 3 has three convex portions 30, 31, 32 and the upper plate 2 has three convex portions 20, 21, 22 that correspond to the convex portions 30, 31, 32, respectively, and the thick base portions or pedestals 17 (and thus the cleats 15) of the heel portion H are provided only between the adjacent convex portions 30 and 31 and between the adjacent convex portions 31 and 32 of the lower plate 3. Therefore, the base portions 17 are separated in the longitudinal direction in the heel portion H as with the eighth embodiment.

In the above-mentioned sole structure, at the time of striking onto the ground, first, the cleat 15 sticks S into the ground and then, the lower surface of the convex portions 30, 31, 32 of the lower plate 3 contacts the ground. At this time, the void C formed between the upper plate 2 and the lower plate 3 acts as a cushion hole to display cushioning properties of the heel portion H. Moreover, in this case, since the cleat 15 (and thus the base portion 17) is provided only between the adjacent convex portions 30 and 31 and between the adjacent convex portions 31 and 32 of the wavy lower plate 3, compressive deformation of the downwardly convex portions 30, 31 of the wavy lower plate 3 is not restricted at the time of impacting the ground and the cushioning properties of the sole heel portion can thus be improved. Also, in this case, by securing the deformation of the wavy lower plate 3, bending properties of the sole heel portion can be enhanced.

Furthermore, in this case, since the corresponding pairs of convex portions 20, 30; 21, 31; 22, 32 between the upper and lower plate 2, 3 protrude in the opposite direction, a large void C can be secured between the upper and lower plate 2, 3 and the cushioning properties of the sole heel portion can be further improved. Also, since the upper plate 2 is in the shape of a wavy corrugation, deformation of the upper plate 2 also helps improve the cushioning properties of the sole heel portion.

The corresponding pairs of convex portions 20, 30; 21, 31; 22, 32 between the upper and lower plate 2, 3 may protrude in the same direction. At this juncture, in order to secure a void C between the upper plate 2 and the lower plate 3, the radius of curvature of the convex portions of the lower plate 3 is preferably different from the radius of curvature of the corresponding convex portions of the upper plate 2. In the alternative, the corresponding convex portions between the upper plate 2 and the lower plate 3 may be offset in the longitudinal direction.

The application of the present invention is not limited to an example in which the number of convex portions on the medial side of the upper and lower plate 2, 3 is the same as the number of convex portions on the lateral side of the upper and lower plate 2, 3, but the number of convex portions on the medial side may be different from that on the lateral side.

Also, the application of the present invention is not limited to an example in which the upper plate 2 has a wavy corrugation in the heel portion H, but the upper plate 2 may be flat in the heel portion H. In this case, since a flat surface is secured on the upper surface of the upper plate 2, a foot contact surface for the shoe wearer can be easily obtained without providing a midsole on the upper side of the upper plate 2.

Furthermore, the elastic block 6 maybe omitted, In this case, the upper and lower plate 2, 3 need not to be coupled to each other at the position where the elastic block was provided. A clearance may be formed between the upper plate 2 and the lower plate 3. In the case where the upper plate 2 and the lower plate 3 are coupled to each other, the upper and lower plate 2, 3 can be integrally formed, thereby simplifying the manufacturing process and the assembly process.

Figure 10C:
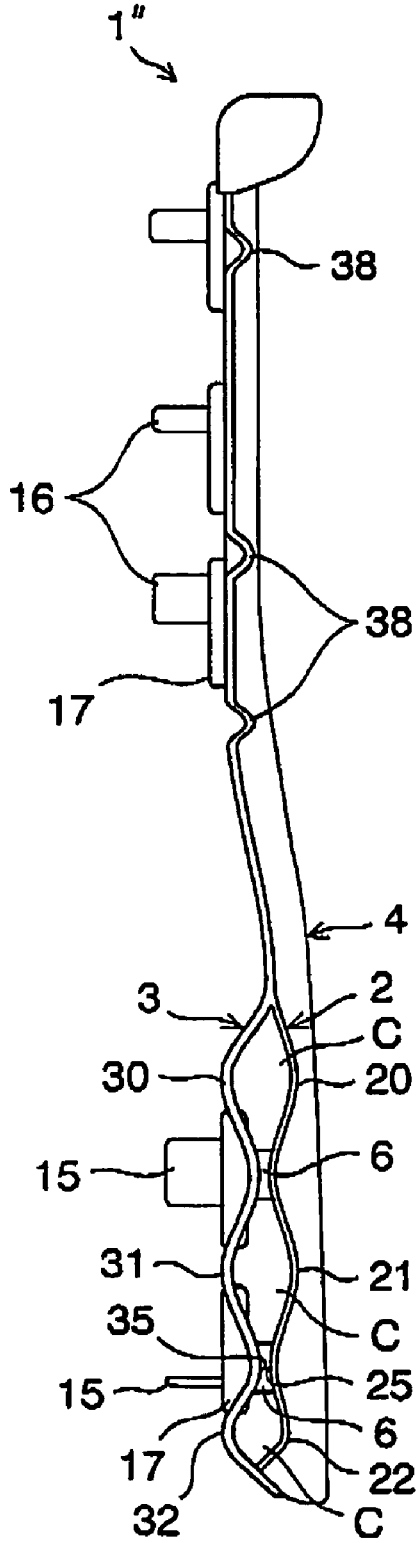
FIG. 10C is a variant of the sole structure of FIG. 10A.

FIG. 10C shows a variant of the ninth embodiment of the present invention. As shown in FIG. 10C, the variant is different from the ninth embodiment in that a plurality of U-shaped or V-shaped bent portions 38 are provided at the lower plate 3 in the forefoot portion F and the midsole 4 extends to the front end of the forefoot portion F. The respective bent portions 38 extend in the width direction of the forefoot portion F. In this case, not only cushioning properties of the sole heel portion can be secured as with the ninth embodiment but also bending properties of the sole forefoot portion can be improved by the bent portions 38.

Figure 10D:
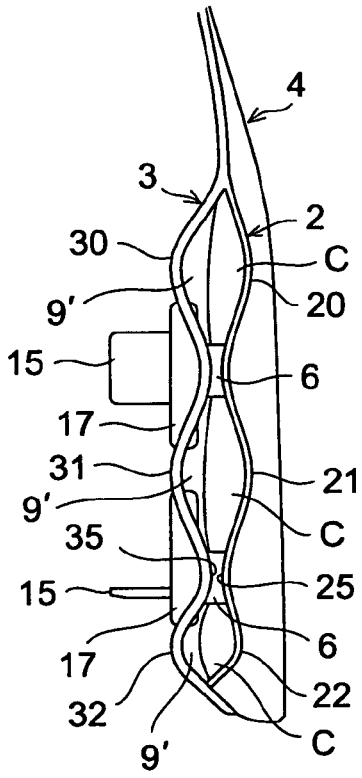
FIG. 10D is a partial side view similar to FIGS. 10A and 10C; showing a further variant with ribs like those of FIG. 7.
Figure 10E:
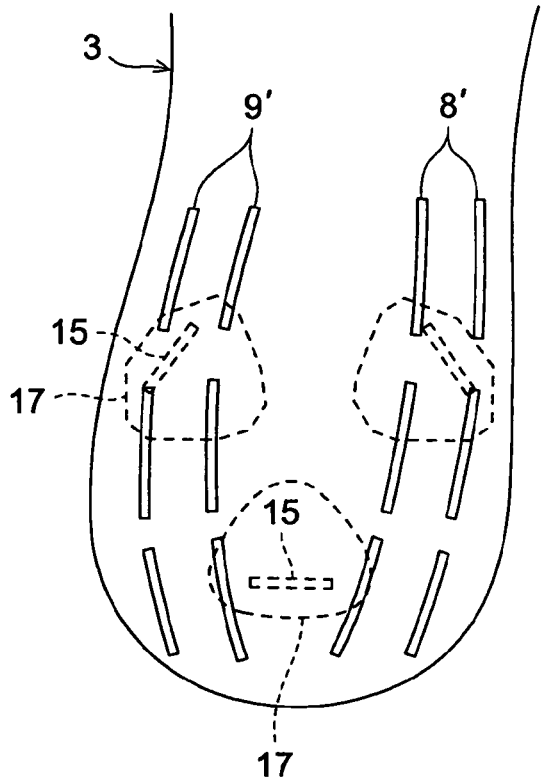
FIG. 10E is a partial top plan view similar to FIG. 7, showing the top surface of the lower plate with ribs in the sole structure according to FIG. 10D.
Figure 11:
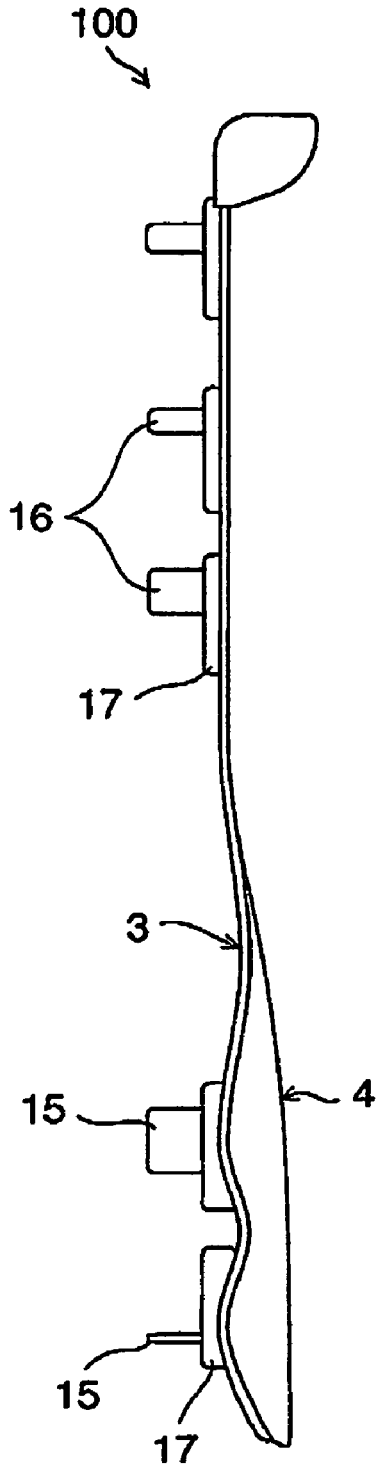
FIG. 11 PRIOR ART
FIG. 11 is a side view of a sole structure of prior art.
Figure 12:
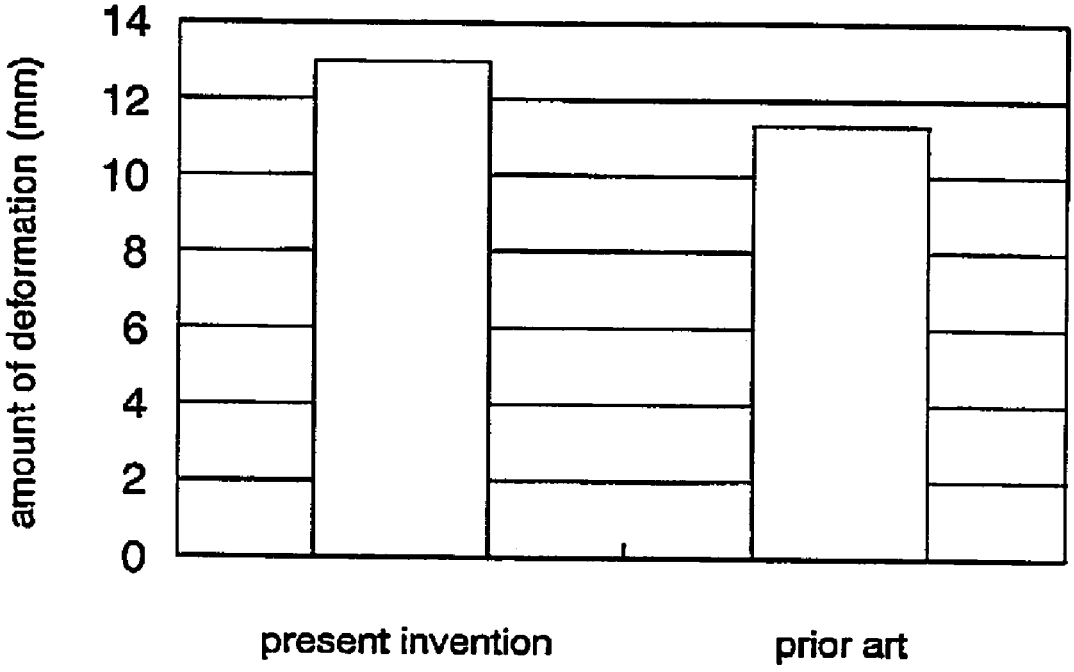
FIG. 12 is a graph showing the result of the impact test in which a weight falls from the predetermined height to exert an impact load to the sole structure of the present invention (FIG. 9A) and the prior art sole structure (FIG. 11), illustrating the difference of the amount of deformation in both the sole structures.

FIGS. 10D and 10E show a sole structure similar to FIGS. 10A, 10B and 10C, but according to a further variant having cleats 15 mounted on pedestals or bases 17 on the 9' integrally formed with the upper surface of the lower plate 3 at positions corresponding to the downwardly convex portions 30, 31 and 32.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

an upper plate disposed on an upper side of a heel region of the sole structure;

a wavy lower plate disposed on a lower side of the heel region of the sole structure, and having a lower surface that is downwardly exposed as a bottom ground contact surface of the sole structure in the heel region, and having at least two downwardly convex portions that form voids relative to the upper plate, and having at least one upwardly convex portion between the downwardly convex portions, wherein the upwardly convex portion forms a void relative to a plane touching the lower surface at the downwardly convex portions; and at least one of the following features:

a plurality of cleats that are mounted on the lower surface of the downwardly convex portions of the lower plate, and/or a cleat that is mounted on the lower surface of the lower plate between adjacent ones of the downwardly convex portions of the lower plate.

2. The sole structure according to claim 1, wherein the upper plate is wavy in shape.

3. The sole structure according to claim 2, wherein the upper plate has convex portions that protrude in the opposite direction of the protruding direction of the convex portions of the lower plate at the positions corresponding to the convex portions of the lower plate.

4. The sole structure according to claim 2, wherein the upper plate has convex portions that protrude in the same direction as the protruding direction of the convex portions of the lower plate at the positions corresponding to the convex portions of the lower plate.

5. The sole structure according to claim 1, further comprising an elastic block member disposed between the upper plate and the lower plate, and wherein the upper plate and lower plate are coupled to each other through the elastic block member.

6. The sole structure according to claim 5, wherein the upper plate is wavy-shaped and includes a downwardly convex portion between two upwardly convex portions, and wherein the upwardly convex portion of the lower plate is coupled through the elastic block member to the downwardly convex portion of the upper plate.

7. The sole structure according to claim 6, wherein the upwardly convex portion of the lower plate is disposed opposite the downwardly convex portion of the upper plate in the vertical direction.

8. The sole structure according to claim 6, wherein the upwardly convex portion of the lower plate is disposed offset in the longitudinal direction relative to the downwardly convex portion of the upper plate.

9. The sole structure according to claim 1, wherein the number of convex portions of the lower plate is different between the medial side and the lateral side of the sole structure.

10. The sole structure according to claim 1, wherein the upper plate is flat in shape.

11. The sole structure according to claim 1, further comprising a midsole of a soft elastic material disposed on the upper side of the upper plate.

12. The sole structure according to claim 1, further comprising a longitudinally extending rib that is integrally formed with at least one of the upper and lower plates.

13. The sole structure according to claim 12, wherein the rib is provided at least either on the medial side or on the lateral side of the upper or lower plate.

14. The sole structure according to claim 13, further comprising a plurality of the longitudinally extending rib, wherein the number of the ribs is different between the medial side and the lateral side of the upper or lower plate.

15. The sole structure according to claim 1, having said plurality of cleats mounted on the lower surface of the downwardly convex portions of the lower plate.

16. The sole structure according to claim 15, further comprising a longitudinally extending rib that is integrally formed with the lower plate, and that is disposed at a position corresponding to one of the cleats.

17. The sole structure according to claim 1, having said cleat mounted on the lower surface of the lower plate between the adjacent downwardly convex portions of the lower plate.

18. The sole structure according to claim 17, further comprising a longitudinally extending rib that is integrally formed with the lower plate, and that is disposed at a position corresponding to one of the downwardly convex portions of the lower plate.

19. The sole structure according to claim 1, having the plurality of cleats mounted only on the lower surface of the downwardly convex portions of the lower plate, and not having any cleat between the downwardly convex portions of the lower plate.

20. The sole structure according to claim 1, having the cleats fixedly attached onto the lower surface of the lower plate.

21. The sole structure according to claim 1, wherein the cleats each include a cleat member and a cleat pedestal, the cleat member is mounted on the cleat pedestal, and the cleat pedestal is fixedly attached to the lower plate.

22. The sole structure according to claim 21, wherein the cleat pedestal is fixedly attached to the lower plate by being a one-piece integral structure with the lower plate.

23. The sole structure according to claim 1, wherein the voids are located directly above the lower plate vertically above locations of the cleats.

24. The sole structure according to claim 1, wherein the upper and lower plates are integrally joined together as a one-piece structure at a rear end of the heel region and at a midfoot region of the sole structure.

* * * * *

UNITED STATES PATENT AND TRADEMARK OFFICE

CERTIFICATE OF CORRECTION

PATENT NO. : 7,624,515 B2
APPLICATION NO. : 11/444153
DATED : December 1, 2009
INVENTOR(S) : Kita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 656 days.

Signed and Sealed this

Twenty-sixth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,624,515 B2
APPLICATION NO. : 11/444153
DATED : December 1, 2009
INVENTOR(S) : Kita et al.

It is certified that error appears in the above-identified patent and that said Letters Patent is hereby corrected as shown below:

Column 1,
Line 6, after "of", insert --copending--;

Column 3,
Line 30, after "form", replace "avoid" by --a void--;

Column 6,
Line 19, after "invention", replace ":" by --;--;
Line 32, after "10C", replace ";" by --,--;
Line 47, after "drawings", replace "." by --,--;

Column 9,
Line 63, after "21", replace "." by --,--;

Column 11,
Line 43, after "ribs", replace "maybe" by --may be--;

Column 14,
Line 22, after "sticks", delete "S";

Column 15,
Line 4, after "omitted", replace "," by --.--;
Line 25, after "the", insert --lower surface of the lower plate 3, as well as ribs 8' and--.

Signed and Sealed this
Fifth Day of April, 2011

David J. Kappos

David J. Kappos
*Director of the United States Patent and Trademark Office*